United States Patent [19]

Tonokowa et al.

[11] Patent Number: 4,869,762

[45] Date of Patent: Sep. 26, 1989

[54] INSULATION OF VESSELS HAVING CURVED SURFACES

[75] Inventors: Hiroshi Tonokowa, Kanuma, Japan; Emil Ekker, Bergfloetveien, Norway; Hubert S. Smith, Essexville, Mich.

[73] Assignee: The Dow Chemical Company, Midland, Mich.

[21] Appl. No.: 789,200

[22] Filed: Oct. 18, 1985

Related U.S. Application Data

[60] Continuation of Ser. No. 627,169, Jul. 2, 1989, abandoned, which is a division of Ser. No. 492,765, May 9, 1983, abandoned.

[51] Int. Cl.[4] ..... B65D 25/18

[52] U.S. Cl. ..... 156/186; 156/188; 156/195

[58] Field of Search ..... 156/185–188, 156/195; 52/309.8, 309.9

[56] References Cited

U.S. PATENT DOCUMENTS

| | | | |
|---|---|---|---|
| 2,405,330 | 8/1946 | Ryder | 156/188 X |
| 3,337,384 | 8/1967 | Wright | 156/195 X |
| 4,050,607 | 9/1977 | Smith | 156/186 X |
| 4,510,726 | 4/1985 | MacDonald | 52/309.8 |

*Primary Examiner*—David Simmons

[57] ABSTRACT

Cryogenic vessels provided with improved thermal insulation by spirally generating two layers of thermal insulation thereon; permits thicker insulation without requirement of increased space and heavier equipment.

7 Claims, 2 Drawing Sheets

INSULATION OF VESSELS HAVING CURVED SURFACES

Figure 1:
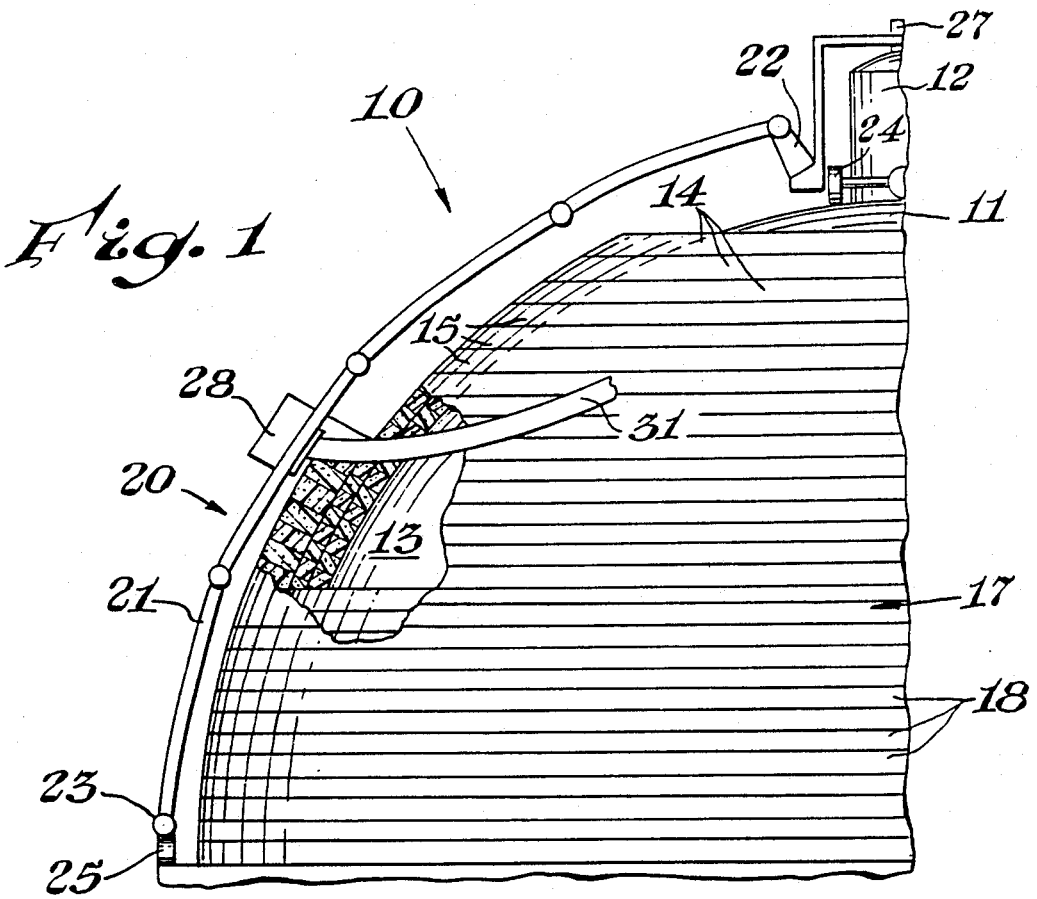

This is a continuation of application Ser. No. 627,169 filed 7/2/84, which is a division of 492,765, filed 5/9/83, both now abandoned.

In the transportation of cryogenic liquids such as liquefied natural gas, vessels utilized must have a relatively high degree of thermal insulation to prevent loss of the liquefied cargo during transportation. A variety of ships have been designed for the transportation of liquefied natural gas. One of the more desirable designs for such vessels employs spherical tanks which are ecuatorially supported. Such ships generally utilize a plurality of spherical tanks, the tanks having an equatorial flange, the flange being supported by a generally cylindrical skirt which is affixed to the hull of the ship. The use of the generally spherical tank provides containers which provide a minimal surface to volume ratio thereby minimizing the surface which must be provided with suitable thermal insulation to prevent undesirable vaporization of the cryogenic cargo. Such spherical tanks are useful not only for shipboard applications but for land based storage also. Tanks for cryogenic liquids have been employed which have a variety of configurations such as rectangular, cylindrical and the like. Cryogenic tanks have been insulated by a variety of methods. One method that has found some favor is the so-called panel insulating method wherein the cryogenic tank has applied thereto a plurality of panels of insulating material and the adjacent panels being bonded to each other by means of suitable adhesive, for example a foamed in place urethane foam. The panel insulating technique is labor intensive and for many applications is therefore undesirable. When employed with tanks of rectangular configuration, the panel system provides minimal difficulty in fitting. When the panel system is applied to nonrectangular tanks such as those of cylindrical or spherical configuration, the amount of effort in the cutting and fitting of the tanks is generally found to be undesirably time consuming. Vessels having rotational symmetry such as those of cylindrical or spherical configuration beneficially may be insulated using the so-called spiral generation process. The term "spiral generation" refers to the preparation of structures by the progressive deposition of a foam or like construction material by a material depositing means which travels about a predetermined path to deposit successive loops or turns. The progressive loops being adhered to adjacent loops. In effect when a vessel is insulated by the spiral generation technique, effectively a strip of insulating material is wound about the vessel to be insulated and the adjacent turns of the strip are affixed to each other. Spiral generation and variations thereof are set forth in the following U.S. Pat. Nos.: 3,206,899; 3,337,384; 3,443,276; 3,507,735; 3,874,983; 3,879,254; 3,902,943; 3,919,034; 3,923,573; 3,924,039; 4,017,346; 4,050,607; 4,098,635; and 4,175,998, the teachings of which are herewith incorporated by reference thereto.

U.S. Pat. No. 4,017,346 discloses specific apparatus and a method for the application of foam thermoplastic insulation to a cryogenic vessel of rotational symmetry. A composite strip or log is applied to the vessel, the log having a vapor barrier disposed remote from the vessel, the vapor barrier generally being a flexible aluminum sheet. The thermoplastic foam of the log is heat bonded to adjacent loops as is the aluminum skin bonded to its adjacent turns by means of heat sealing or crimping or like connecting means.

In a typical application of thermal insulation to a vessel having rotational symmetry by the spiral generation method, a log of perhaps about 20 centimeters square cross section is employed. Such insulation is readily accomplished employing the method and apparatus 25 as set forth in U.S. Pat. No. 4,017,346. In general, the application of insulation by the spiral generation technique becomes easier as the cross section of the insulating strip is reduced. Generally as the size of the cross section configuration of the strip being deposited increases, the mass of equipment required- to deposit such a strip also increases. In most instances it is very desirable that the size of the apparatus employed to deposit a strip of insulating material in the spiral generation process be maintained at a minimum. This is particularly true in the case of shipboard installations where generally a tank such as a spherical tank is installed at least partially within the hull of a ship and the insulation is applied to the tank after such installation. Oftentimes a weather shield is provided for such a tank when a portion of the tank protrudes above the hull of the ship. Advantageously, the mass and volume of the spiral generation equipment employed to apply insulation is maintained at a minimum volume and minimal weight. Ideally the spiral generation equipment is of relatively low volume and low weight which facilitates moving the equipment from one location to another and requires minimal space about the tank for its operation during the application of insulating material.

A very critical element in cryogenic insulation is the vapor barrier which as disclosed in U.S. Pat. No. 4,017,346 comprises an external aluminum skin, enclosing the vessel and the insulation material. In the event that water vapor has ready access to the insulation area of the cryogenic vessel, a buildup of ice can occur and result in a substantial and significant loss of the insulating value. The insulating system set forth in U.S. Pat. No. 4,017,346 was very satisfactory for use in shipping liquefied natural gas when the value of liquefied natural gas was relatively low. The single layer of insulation and vapor barrier provided adequate insulation and protection of the cryogenic vessel wherein liquefied natural gas which vaporized was conducted from the cryogenic tank to provide fuel for the ship. As the value of liquefied natural gas increased relative to heavy fuel oils such as Bunker C, it became desirable to have increased thermal insulation on vessels employed to transport and/or store liquefied natural gas.

It would be desirable if there were available an improved insulated cryogenic vessel.

It would also be desirable if there were available an improved cryogenic vessel having thermal insulation disposed thereabout which had improved vapor barrier characteristics.

It would also be desirable if there were available an improved method for the insulation of cryogenic vessels.

It would also be desirable if there were available an improved method for the spiral generation application of thermal insulation to cryogenic vessels.

It would also be desirable if there were available an improved method for the application of thermal insulation to cryogenic vessels by spiral generation technique which permitted applying thermal insulation having a relatively high resistance to the flow of heat thereto, utilizing equipment having minimal weight and volume.

These benefits and other advantages in accordance with the present invention are achieved in an improved insulated cryogenic vessel, the cryogenic vessel comprising at least a first containment vessel having an exterior curved surface, a first layer of insulation disposed adjacent the exterior surface and covering at least a substantial portion thereof, the insulation being in the form of a plurality of loops or turns of a strip-like configuration, adjacent turns of the insulation being adhered to each other; a second layer of insulation being disposed over at least a portion of the first layer of insulation and external thereto, the second layer of insulation being in the form of a plurality of loops or turns of strip-like configuration, adjacent turns of the insulation being adhered to each other.

Also contemplated within the scope of the present invention is a method for the insulation of cryogenic vessels wherein a thermally insulating material is deposited about the periphery of the vessel in the form of a plurality of closed loops to thereby envelop at least a portion of the vessel within a first insulating layer, subsequently depositing at least a second insulating layer about the first insulating layer, the second insulating layer being in the form of a plurality of closed loops to thereby envelop at least a portion of the first insulating layer.

Figure 2:
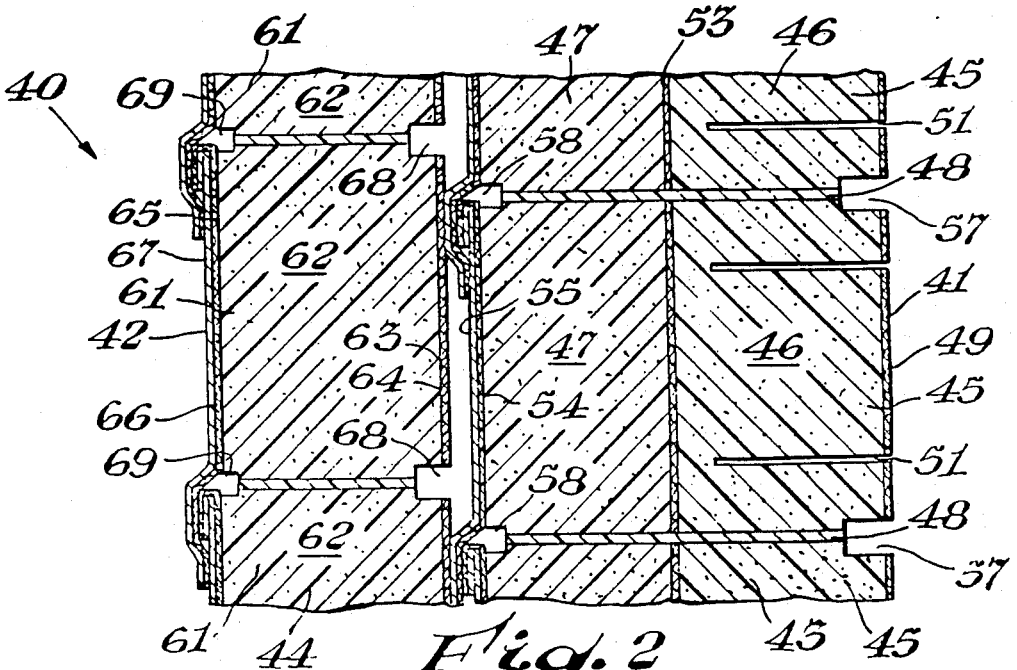
Figure 3:
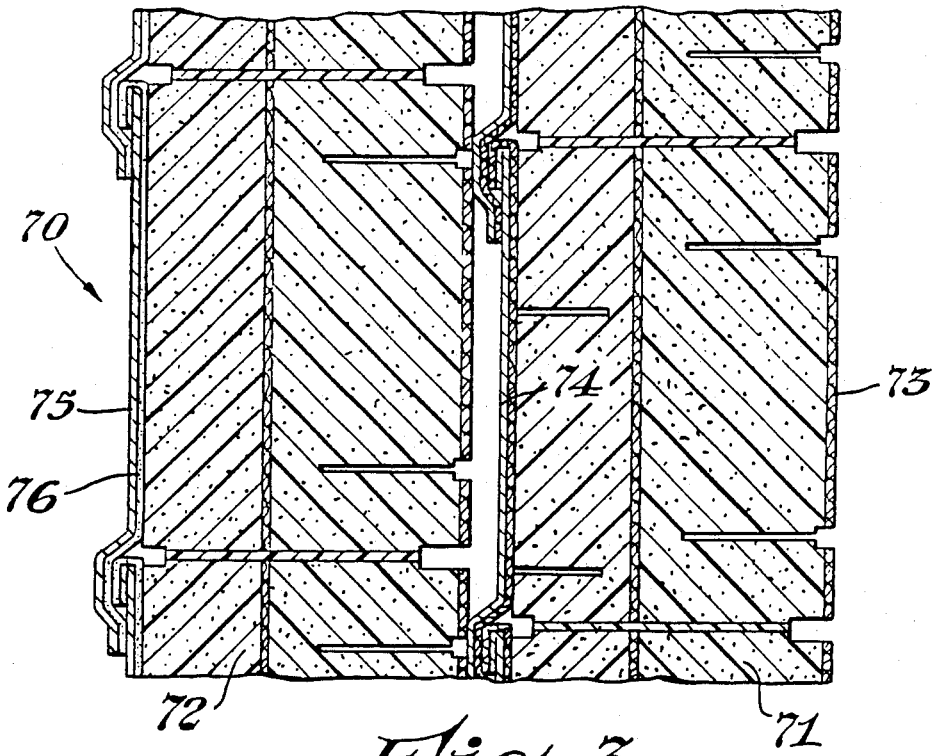
Figure 4:
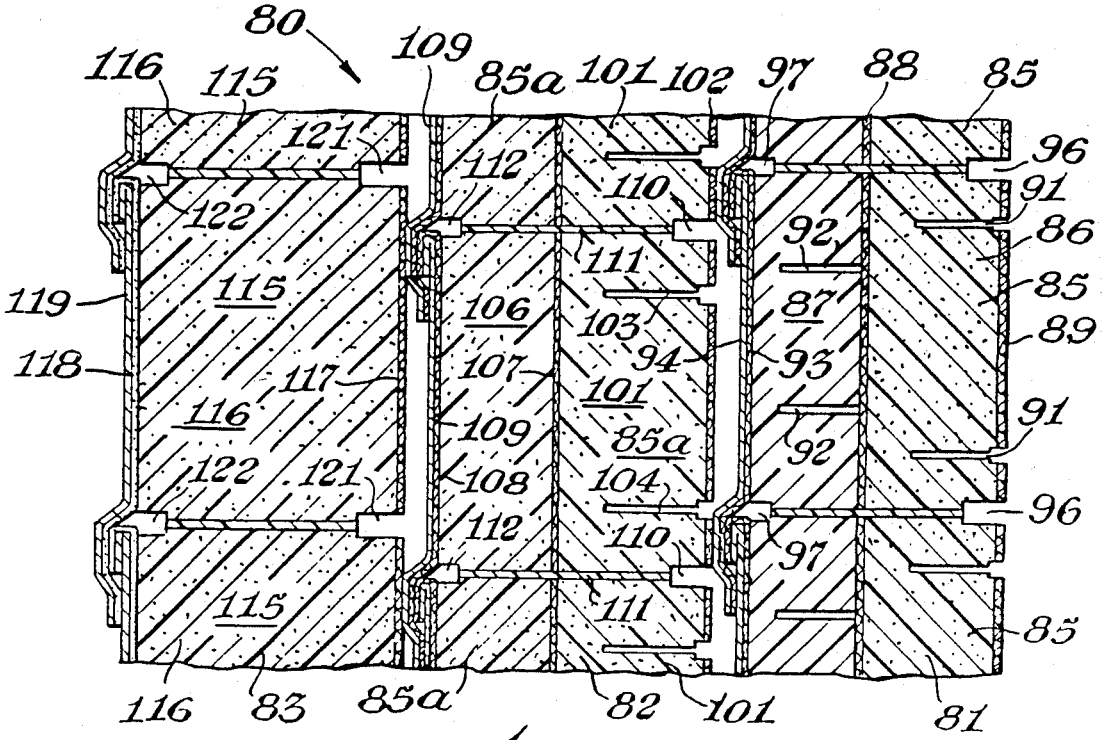

Further features and advantages of the present invention will become more apparent from the following specification taken in connection with the drawing wherein FIG. 1 is a fractional view of a vessel being insulated in accordance with the present invention;

FIGS. 2, 3 and 4 depict cross sectional configurations of insulation applied in accordance with the present invention.

In FIG. 1, there is schematically depicted a factional view of a vessel being insulated in accordance with the present invention, the insulated vessel is generally indicated by the reference numeral 10. The vessel 10 comprises in cooperative combination a first or inner containment vessel 11 having a generally spherical configuration. The vessel 11 has affixed thereto a dome 12. The vessel 11 has an external surface 13. Adjacent the external surface 13 of the vessel 11 is a first layer of insulation generally indicated by the reference numeral 14. The insulation layer 14 is formed of a plurality of closed loops 15 of insulating material, the loops 15 of insulating material being adjoined to adjacent loops A second layer of insulating material 17 is disposed external to the layer 14 of insulating material. The layer 17 comprises a plurality of closed loops 18 of insulating material, the adjacent portions of the loops 18 being affixed to each other. A spiral generation depositing apparatus generally designated by the reference numeral 20 is rotatably mounted adjacent the tank 11 and generally spaced therefrom. The spiral generation apparatus 20 comprises an arcuate boom 21. As depicted in FIG. 1, the boom 21 has an upper or axial end 22 and a lower or equatorial end 23. The ends 22 and 23 are supported by means of rollers 24 and 25 respectively. The upper end 22 of the boom 21 is rotatably fixed to a generally axially disposed pivot 27 affixed to the dome 12 of the tank 11. An insulation depositing head 28 is supported by the boom 21, the head 28 being adapted to move along the boom 21 generally between the ends 22 and 23. A strip or log of insulating material 31 is engaged by the depositing head 28 and the strip 31 effectively wound about the vessel 11 to form the second insulating layer 17. Both of the insulating layers 14 and 17 are deposited by the foam or insulation depositing apparatus 20 which rotates about the vessel 11 as the insulation is deposited in the manner described in U.S. Pat. No. 4,017,346.

In FIG. 2 there is schematically depicted a cross sectional view of a portion of insulation in accordance with the present invention generally designated by the reference numeral 40. The insulation 40 has a first or inner side 41 and a second or external side 42. The insulation 40 comprises a first or inner layer 43 and a second or outer layer 44. The inner layer 43 comprises a plurality of the reference numeral 45. Each of the loops or turns 45 comprises a first or inner log portion 46 and a second or outer portion 47. Adjacent portions of the loops or turns 45 are joined together at joints 48. Advantageously such joints 48 are formed between adjacent turns by heating thermoplastic foam forming portions 46 and 47 to a temperature sufficiently high that in effect the foam melts and adjacent turns such as turns 45 are heat bonded together. The inner surface 41 of the insulation 40 has disposed thereon and affixed thereto a reinforcing scrim 49. Advantageously, the reinforcing scrim 49 is an open weave glass cloth which provides mechanical reinforcement for the foam of portions 46. Each of the turns 45 defines slots 51 which extend from the face 41 inward generally normally and partially through the portions 46. Between portions 46 and 47 is disposed a reinforcing scrim 53. The scrim 53 is disposed in a heat bond between portions 46 and 47. The scrim 53 advantageously is an open weave glass cloth and provides mechanical reinforcement for the loops or turns 45. The portions 47 of loops 45 remote from the inner face 41 have affixed thereon an optional glass reinforcing scrim 54 which in turn is adhered to a vapor or gas barrier layer 55, advantageously of aluminum. The vapor barrier layer is wider than the loops 45 and is heat sealed by means of appropriate hot melt adhesives to adjacent portions of vapor barrier material 55 on adjacent turns 45. Each of the turns 45 adjacent its edges defines a rebate or groove 57 adjacent the inner or cold side 41 and rebates or grooves 58 adjacent the vapor barrier 55. Advantageously, the adjacent recesses 57 form a groove generally adjacent the inner face 41 and provide clearance for a heat sealing platen when the joints or fused portions 48 are formed. The recesses 58 result in a groove outwardly facing from surface 41 of the adjacent loops 45 and facilitate the sealing and folding of adjacent portions of the vapor barrier 55 and folding of the sealed portions so that the sealed portions lie generally parallel to the major portions of the vapor barrier 55. The insulation layer 44 comprises a plurality of loops or turns 61. Each of the turns 61 has a body portion 62 of synthetic resinous thermoplastic foam and inner face 63, having affixed thereto an optional reinforcing scrim 64 such as an open weave glass cloth. The body 62 has an external or outer face 65 having adhered thereto a reinforcing scrim 66 which in turn has adhered to a gas or vapor barrier 67 generally equivalent to the vapor barrier 55. The foam body 62 has first or inner rebates 68. The adjacent rebates 68 form grooves opening toward the inner face 63. Similar rebates 69 are formed adjacent the outer face 65 and form outwardly opening grooves which face the vapor barrier 67.

In the insulation 40 as depicted in FIG. 2, the slots 51 provide stress relief when the inner face 41 is cooled to cryogenic temperature. The reinforcing scrim 53 provides an effective means of terminating any cracks which might result from shrinkage of the insulation adjacent face 41 and minimize the tendency of cracks to form which would run vertically, that is in the plane of the paper. The scrim 54 mounted adjacent the vapor barrier 55 provides added mechanical reinforcement to resist thermal stress on cooling of the inner face 41 of the insulation 40 to cryogenic temperatures. The second insulating layer 44 as depicted in FIG. 2 provides additional thermal insulation and mechanical protection for the vapor barrier 55. The insulation embodiment 40 of FIG. 2 effectively provides two concentric vapor barriers which provide a high degree of reliability both from a containment point of view in the event of leakage from the tank which is insulated and from the water vapor permeation from the space external to the tank. The grooves in the insulation formed by the rebates 57, 58, 68 and 69 provide convenient paths for the flow of purge gas when desired.

The thermoplastic foam used in the practice of the present invention may be any one of a variety of foams. However, particularly desirable are styrene polymer foams such as polystyrene foam having a density generally in the range of about 1.5 to about 2.5 pounds per cubic foot, and advantageously for many cryogenic applications, it is desirable to flexibilize the foam. This is done by a controlled crushing of the foam to render it more easily bendable. Flexibilizing of such foams is well known and set forth in U.S. Pat. Nos. 3,159,700 and 3,191,224. Flexibilizing the foam employed for insulation in accordance with the present invention generally facilitates handling of the foam as it is fed to the foam depositing head. Flexibilization also increases the elongation at break of the foam and therefore reduces the tendency of such foam to crack when subjected to cryogenic temperatures.

In FIG. 3, there is schematically depicted a cross sectional view of insulation in accordance with the present invention, generally designated by the reference numeral 70. The insulation 70 comprises a first insulating layer 71 and a second insulating layer 72. The insulating layer 71 is disposed adjacent the vessel to be insulated. The insulating layer 71 is generally of identical construction to the insulating layer 43 of FIG. 2. The layer 71 has an inner or cold side 73 and an outer or warm side 74. The second layer 72 is of similar construction to the layer 71 with the exception that an optional scrim beneath the vapor barrier layer 75 of the outer layer 72 has been omitted and the vapor barrier is directly adhered by means of a suitable hot melt adhesive 76 to the foam forming the loops or turns which make up the layer 72. The arrangement as depicted in FIG. 3 utilizing two layers of generally equal thickness provides a mechanically desirable insulation and minimizes equipment changes in the preparation of the laminate material forming the loops of each layer. On completion of the formation of the logs or insulating strips which make up the loops of the layer 71, laminates for the second layer 72 are readily prepared by omitting the scrim adjacent the vapor barrier. Thus the materials for layer 71 and 72 may be prepared and deposited without undesirable equipment changes or adjustment.

Generally in the preparation of insulation in accordance with the present invention, it is often desirable to stagger, that is offset, the joints between the turns forming the successive layers. Such an offset or staggering minimizes the possibility of propagation of cracks in the fused joint between adjacent turns from one layer to another.

In FIG. 4, there is schematically depicted a fractional cross sectional view of an alternate embodiment of insulation in accordance with the present invention generally designated by the reference numeral 80. The insulation 80 comprises in cooperative combination a first insulating layer 81, a second or intermediate insulating layer 82 and a third or outer insulating layer 83. The insulating layer 81 comprises a plurality of loops or turns 85 joined to each other in edge to edge relationship. Each of the loops or turns 85 comprises a first or inner foam plastic body 86 and a second or outer foam plastic body 87. The bodies 86 and 87 are laminated together and have therebetween a reinforcing scrim 88 such as an open weave glass cloth. A generally similar scrim 89 is affixed to the face of body 86 remote from body 87. The body 86 defines contraction slots 91. The slots 91 extend inwardly to the body from the face having scrim 89. The body 87 has contraction slots 92 which extend inwardly from the scrim 88. Each of the turns 85 has affixed thereto a reinforcing scrim 93 which is disposed on from scrim 88. The reinforcing scrim 93 has adhered thereto and body 87 a vapor barrier 94. The vapor or gas barrier 94 is sealed to adjacent vapor or gas barriers on the turns or loops 85 of the first insulating layer 81. The edges of adjacent turns 85 define inwardly extending grooves 96, extending inwardly from the face having scrim 89. The adjacent turns 85 also define grooves 97 which extend inwardly from the face having the vapor barrier 94. The intermediate layer 82 is of generally like construction to the construction of the inner layer 81 and comprises a plurality of loops or turns **85*a*. Each of the loops turns 85*a* comprises a first or inner foam body 101 having adjacent turns 85, a reinforcing scrim 102 affixed thereto. The body 101 defines a pair of contraction slots 103 and 104 which extend inwardly from the scrim 102. A second generally rectangular foam body 106 is laminated to body 101 and a reinforcing scrim 107 is affixed between the bodies 101 and 106. The body 106 has affixed thereto an outer reinforcing scrim 108 which is generally parallel to scrims 107 and 102 and disposed remote therefrom. Affixed to the body 106 immediately adjacent the scrim 108 is a vapor barrier 109. The vapor barrier 109 is affixed and adhered to adjacent vapor barrier 109 of the loops or turns 85*a*. The turns 85*a* define therebetween first or inner slots or grooves 110 in the region of a fused joint 111 between the adjacent turns. The grooves 110 depend generally inwardly from the scrim 102. Generally similar grooves 112 are defined between adjacent turns 85*a* adjacent the scrim 108 and vapor barrier 109. The third or outer layer of insulation comprises a plurality of loops or turns of insulating material, the loops or turns being generally designated by the reference numeral 115. Each of the loops or turns 115 comprises a foam body 116 having a generally rectangular cross section. The turns 115 have a reinforcing scrim 117 affixed generally adjacent the intermediate insulation layer 82. A vapor barrier layer 118 is affixed remote from and parallel to the reinforcing scrim 117. The vapor barriers 118 are adhered to the body 116 by means of an adhesive layer 119. Adjacent portions of the vapor barriers 118 of the turns 115 are adhered together and folded to lie generally at parallel to the scrim 117. Adjacent turns 115 define therebetween first inwardly facing grooves 121 which are inwardly facing and extend inwardly from the scrim 117. The adjacent turns 115 also define outwardly facing grooves 122** which extend inwardly toward the grooves 121 from vapor barrier 118.

Insulation in accordance with the present invention provides considerable flexibility in the choice of materials. Generally the innermost layer of insulating material can comprise a foam having relatively high elongation and insulating value whereas as one progresses toward the outermost layer of insulation, lower elongation in the foam may be employed depending upon the requirements of the particular insulation installation. The use of multiple vapor or gas barriers is a substantial advantage in that from a practical standpoint, it is difficult to insure the integrity of a single vapor barrier. The use of multiple vapor barriers permits the use of subatmospheric pressure adjacent the tank or container being insulated and such atmospheric pressure can be maintained adjacent the vessel employing a pump of minimal capacity.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed interpreted as being restrictive or otherwise limiting of the present invention, excepting as it is set forth and defined in the hereto-appended claims.

What is claimed is:

1. A method for the insulation of at least a first cryogenic vessel having an outer surface wherein a thermally insulating material is a flexibilized thermoplastic foam insulation having a density of from about 1.5 to 2.5 pounds per cubic foot and having a strip-like configuration having a metal gas barrier layer affixed thereto, depositing the foam with the gas barrier layer remote from the outer surface of the vessel about the periphery of the vessel in the foam of a plurality of closed loops, heat bonding adjacent loops and gas barrier layers together to thereby envelop at least a portion of the vessel within a first insulating layer, subsequently depositing at least a second insulating layer about the first insulating layer, the second insulating layer having a metal gas barrier layer disposed remote from the vessel, the layers being in the form of a plurality of closed loops to thereby envelop at least a portion of the first insulating layer, the second insulating layers being deposited and heat bonded in alike manner as the first layer, disposing said second insulation layer over and unadhered to the first insulating layer and external thereto and spaced from the gas barrier layer affixed to the first insulating layer.

2. The method of claim 1 including the step of joining adjacent loops together to define inwardly and outwardly facing grooves between adjacent loops.

3. The method of claim 1 including disposing within at least the first insulating layer a reinforcing scrim which is generally parallel to the outer surface of the vessel.

4. The method of claim 1 including the step of providing a plurality of slots in the loops of the first layer extending into the loops along the length of the loops and generally normal to the vessel's outer surface.

5. The method of claim 4 including the step of providing like slots in the second insulating layer.

6. The method of claim 1 including the step of staggering joints between the loops of successive insulation layers.

7. The method of claim 1 including the step of providing a subatmospheric pressure at the outer surface of the vessel.

* * * * *

UNITED STATES PATENT AND TRADEMARK OFFICE

CERTIFICATE OF CORRECTION

PATENT NO. : 4,869,762

DATED : September 26, 1989

INVENTOR(S) : Hiroshi Tonokowa, Emil Ekker, and Hubert Stacy Smith

It is certified that error appears in the above-identified patent and that said Letters Patent is hereby corrected as shown below:

On the title page, under Related U.S. Application Data, field [60], "1989," should correctly appear as --1984--.

Column 2, line 8, delete the number "25".

Column 3, line 36, "factional" should correctly appear as --fractional--.

Column 4, line 12, proceeding the word of, insert therefor,--loops or turns of insulating material generally designated by --.

Column 6, line 21, proceeding the word on, insert therefor,--body 87 generally paralled to the scrims 88 and 89 and rmote--.

Column 7, line 25, insert --or-- preceeding the word interpreted

Column 8, line 1 "foam" should correctly appear as --form--.

UNITED STATES PATENT AND TRADEMARK OFFICE

CERTIFICATE OF CORRECTION

PATENT NO. : 4,869,762

DATED : September 26, 1989

INVENTOR(S) : Hiroshi Tonokowa et al

It is certified that error appears in the above-identified patent and that said Letters Patent is hereby corrected as shown below:

Column 8, line 11, insert a space between the words a and like.

Signed and Sealed this

Sixth Day of November, 1990

*Attest:*

HARRY F. MANBECK, JR.

*Attesting Officer*

*Commissioner of Patents and Trademarks*